US005947305A

United States Patent [19]

Lin

[11] Patent Number: 5,947,305

[45] Date of Patent: Sep. 7, 1999

[54] MODULAR RACK FOR WINE BOTTLES

[76] Inventor: Chen Yuan Lin, 20 Juan Yau Village, Juan Yau Li, Changhua, Taiwan

[21] Appl. No.: 09/084,111

[22] Filed: May 26, 1998

[30] Foreign Application Priority Data

Jan. 16, 1998 [TW] Taiwan ..... 87200737

[51] Int. Cl.[6] ..... A47B 73/00

[52] U.S. Cl. ..... 211/74

[58] Field of Search ..... 211/74, 75, 194

[56] References Cited

U.S. PATENT DOCUMENTS 3,746,178 7/1973 Wagschal ..... 211/74
3,870,155 3/1975 Galloway ..... 211/74
5,025,936 6/1991 Lamoureaux ..... 211/74
5,197,612 3/1993 Thompson ..... 211/74
5,285,907 2/1994 Franchere et al. ..... 211/74

*Primary Examiner*—Alvin Chin-Shue
*Assistant Examiner*—Sarah Purol
*Attorney, Agent, or Firm*—Bacon & Thomas, PLLC

[57] ABSTRACT

A modular rack for holding wine bottles is formed of a plurality of base frames and support rods. The base frames are provided in the center thereof with a bottle-holding space and in the periphery thereof with a plurality of tenons, mortises, and slots. The base frames are arranged together in various ways such that the tenons of one of the base frames are retained in the mortises of another one of the base frames, and that the support rods are engaged with the slots of the base frames.

5 Claims, 4 Drawing Sheets

MODULAR RACK FOR WINE BOTTLES

FIELD OF THE INVENTION

The present invention relates generally to a wine bottle rack, and more particularly to a modular rack for wine bottles.

BACKGROUND OF THE INVENTION

The conventional wine bottle racks are generally rather cumbersome and therefore can not be moved around easily. In addition, the conventional wine bottles are rather monotonous in design and are not cost-effective.

SUMMARY OF THE INVENTION

It is therefore the primary objective of the present invention to provide a modular rack which is intended to hold wine bottles and is composed of units of standardized size, design, etc. that can be arranged or fitted together in a variety of ways in a do-it-yourself (DIY) manner.

It is another objective of the present invention to provide a modular rack which can be easily packaged and shipped.

It is still another objective of the present invention to provide a modular rack which does not take up too much of the space.

It is still another objective of the present invention to provide a multicolored wine bottle rack.

It is still another objective of the present invention to provide a modular rack which is composed of units that can arranged or fitted together without the use of hand tools.

It is still another objective of the present invention to provide a cost-effective modular rack for wine bottles.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
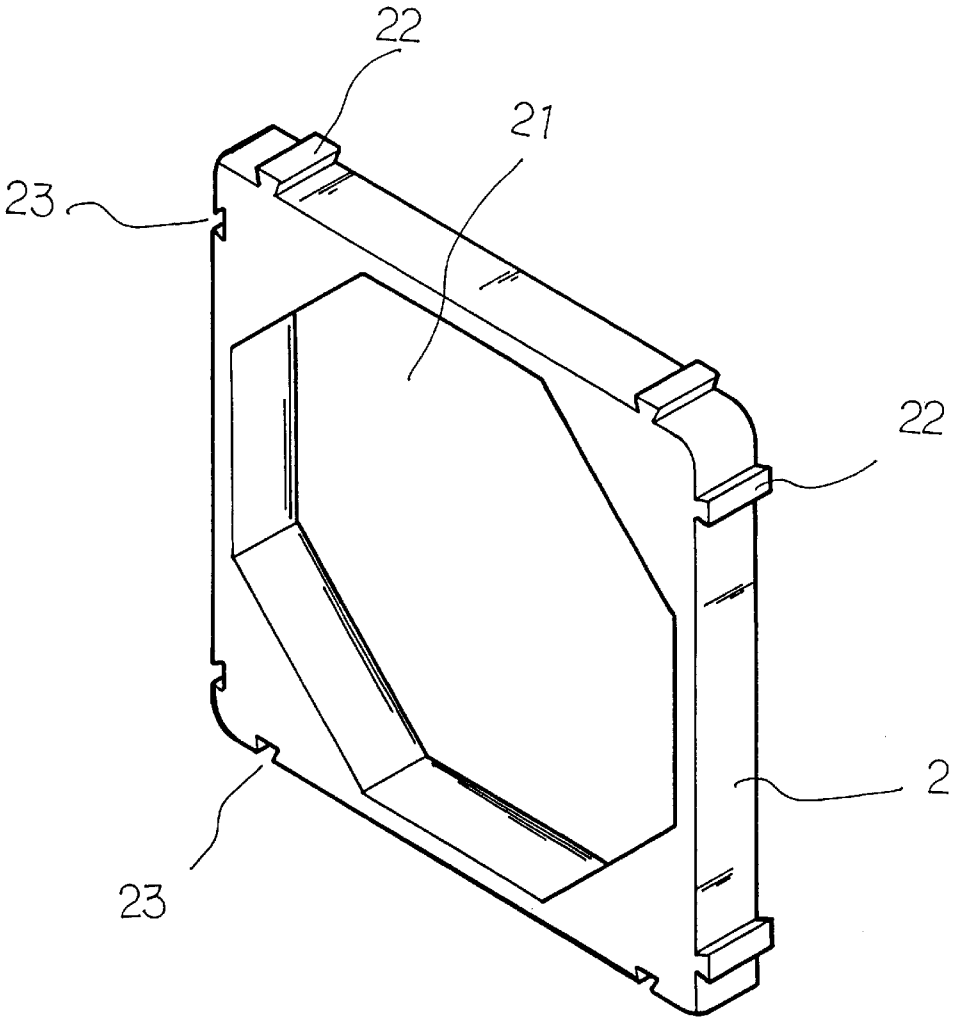
FIG. 1 shows a perspective view of a base unit of the present invention.

As shown in FIGS. 1–4, a modular rack embodied in the present invention is intended to hold the wine bottles and is composed of a plurality of base frames 2 and support rods 3.

The base frames 2 are made of a plastic material by injection molding and are provided with a bottle-holding hole 21 of a rectangular, round, triangular, or polygonal shape. The base frames 2 are further provided in the outer wall surfaces thereof with a plurality of tenons 22 and mortises 23 corresponding in location to the tenons 22. Each of the base frames 2 is further provided in the back side of each of four comers thereof with a slot 24 dimensioned to receive therein one end of the support rods 3. The support rods 3 are tubular in shape and are made of a stone, wooden, metal, or reinforced plastic material.

Figure 2:
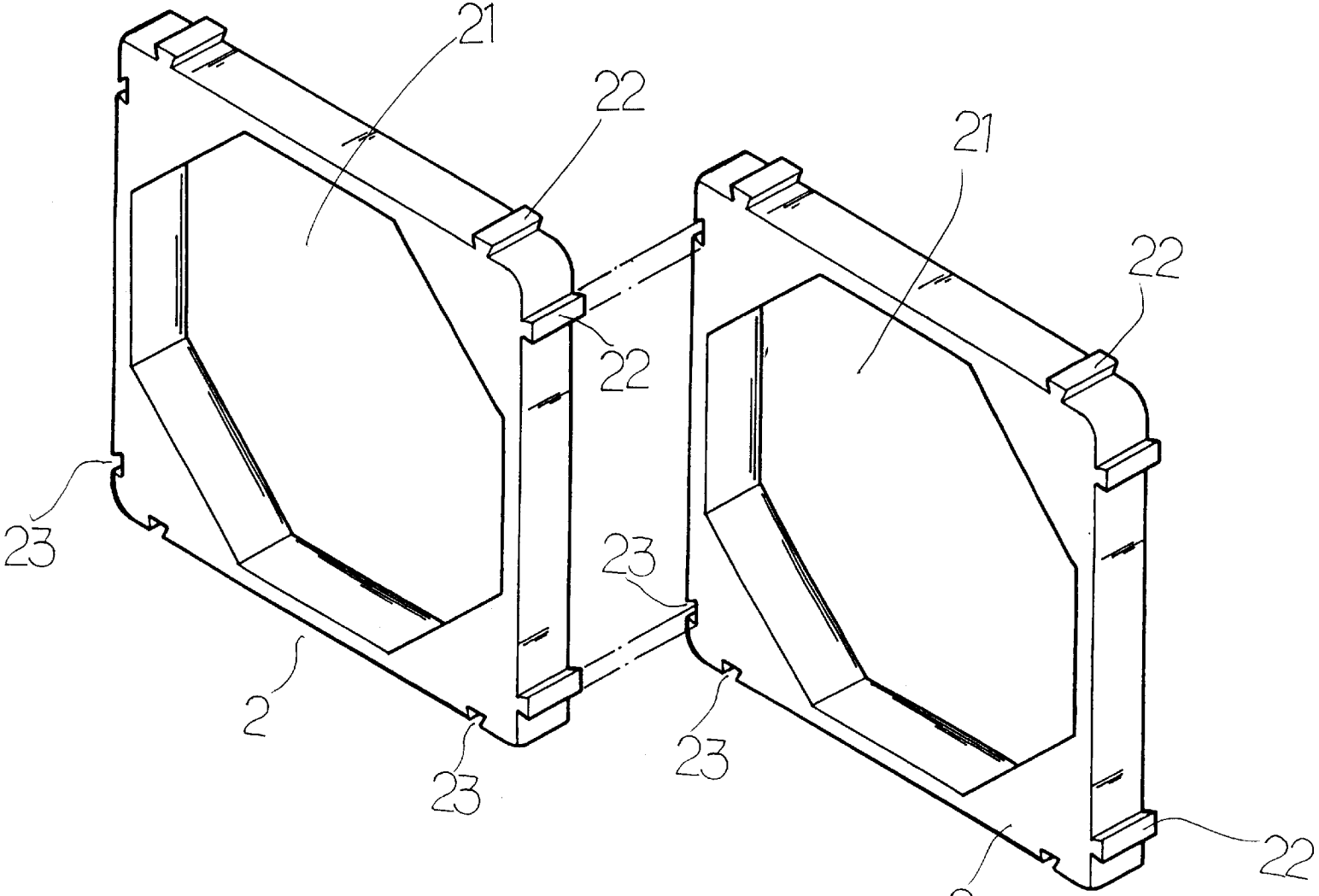
FIG.2 shows a schematic view illustrating the way of fitting together two base units of the present invention.
Figure 3:
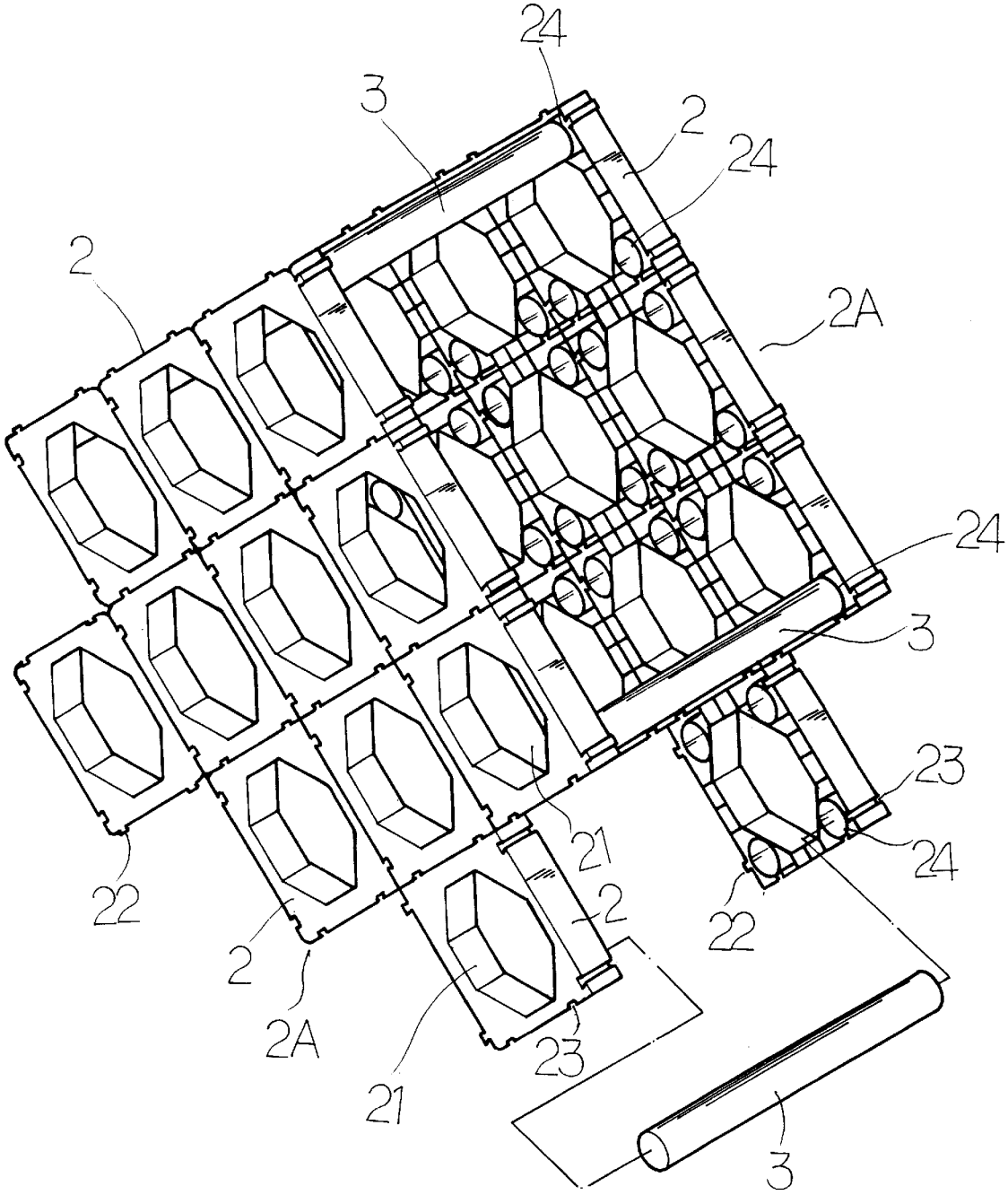
FIG.3 shows a schematic view of the construction of a modular rack of the present invention.
Figure 4:
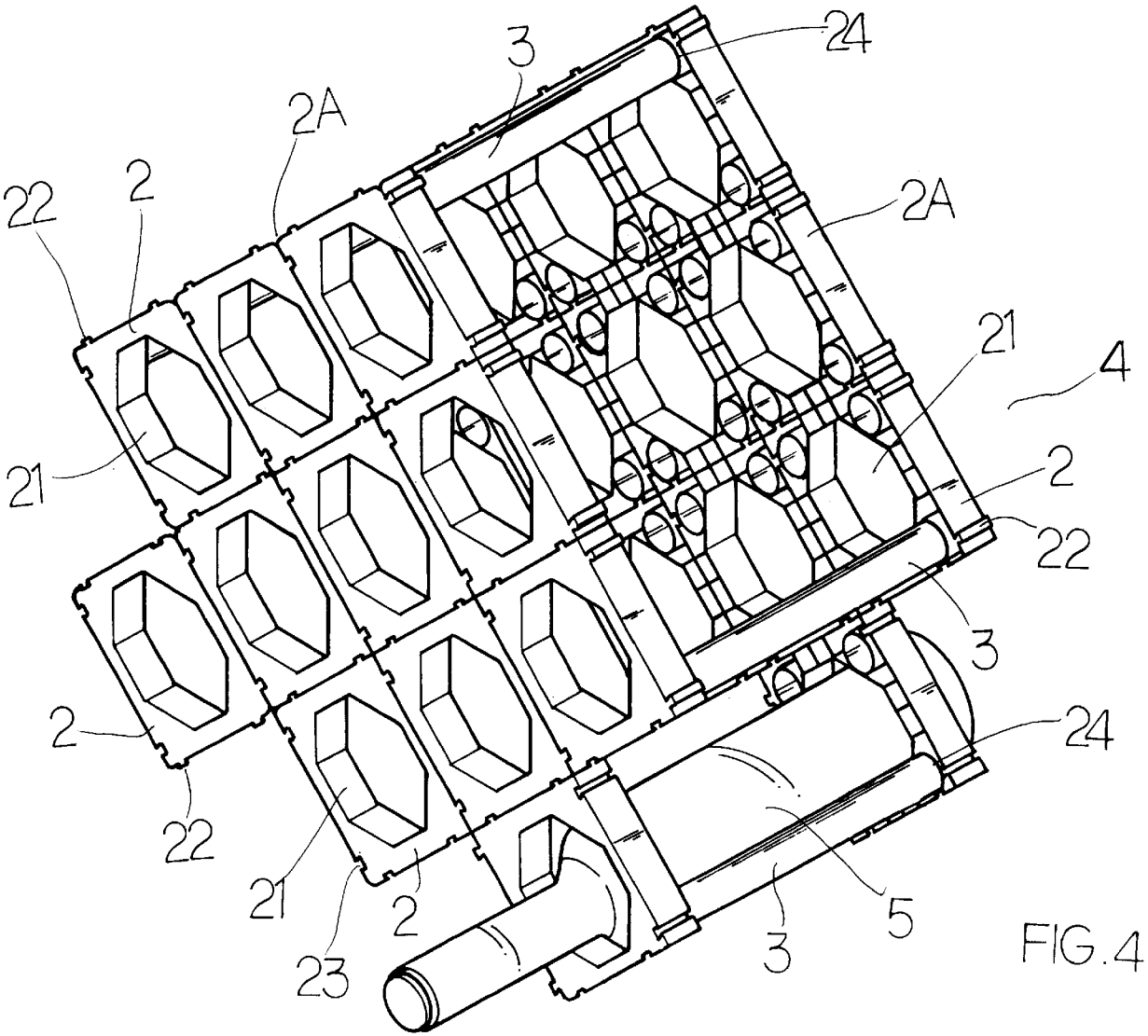
FIG.4 shows a schematic view of the modular rack of the present invention at work.

As shown in FIG.2, the base frames 2 of the present invention are arranged together such that the tenons 22 of one base frame 2 are retained in the mortises 23 of another base frame 2, and that the base frames 2 are arranged together in various ways to form a modular frame 2A by the support rods 3. A plurality of the modular frames 2A can be arranged together to form a frame body 4. The wine bottle 5 is held securely in the holes 21 of the base frames 2, as shown in FIG.4.

In order to enhance the esthetic effect of the modular rack of the present invention, the base frames 2 may be colored differently. As a result, a multicolored modular rack can be formed by joining together a plurality of the colored base frames 2. The modular rack of the present invention is constructed without the help of hand tools.

The modular rack of the present invention is cost-effective in view of the fact that the base frames 2 are of a standardized design and can be thus made by a single type of molding tool.

The versatility of the present invention further enhances the marketability of the modular rack of the present invention.

What is claimed is:

1. A modular rack for holding bottles, said modular rack comprising:

a plurality of based frames, said base frames provided in a center thereof with a bottle-holding hole and in a periphery thereof with a plurality of tenons, mortises, and slots; and a plurality of support rods engageable with said slots of said base frames;

said base frames being arranged to be fitted together in various ways such that:

(a) said tenons of a first of said base frames are retained in said mortises of a second of said base frames to attach said first of said base frames to said second of said base frames, and (b) said first of said base frames is further connected to a spaced from a third of said base frames by said support rods which are engaged at both ends thereof with said slots of said first and third of said base frames.

2. The modular rack as defined in claim 1, wherein said bottle-holding hole of said base frames is rectangular, round, triangular, or polygonal in shape.

3. The modular rack as defined in claim 1, wherein said base frames are made of a plastic material by injection molding.

4. The modular rack as defined in claim 1, wherein said support rods are made of a stone, wooden, metal, or reinforced plastic material.

5. The modular rack as defined in claim 1, wherein said base frames are colored differently.

* * * * *